United States Patent [19]

Yogi et al.

[11] Patent Number: 4,520,525

[45] Date of Patent: Jun. 4, 1985

[54] FOOT BRUSH

[76] Inventors: Seigi Yogi, c/o George Spector, 3615 Woolworth Bldg., 233 Broadway; George Spector, 3615 Woolworth Bldg., 233 Broadway, both of New York, N.Y. 10007

[21] Appl. No.: 536,166

[22] Filed: Sep. 26, 1983

[51] Int. Cl.[3] ..... A47K 3/022

[52] U.S. Cl. ..... 15/104.92; 4/574; 4/622

[58] Field of Search ..... 4/573, 571, 574, 622, 4/621; 15/104.92; 128/365, 368, 370

[56] References Cited

U.S. PATENT DOCUMENTS 2,852,793 9/1958 Shelton ..... 15/104.92
3,359,572 12/1967 Blackwell ..... 4/622
3,416,178 12/1968 James ..... 15/104.92
3,548,439 12/1970 Berst ..... 15/104.92
3,973,286 8/1976 Logan ..... 15/104.92

*Primary Examiner*—Stephen Marcus
*Assistant Examiner*—Linda J. Sholl

[57] ABSTRACT

An apparatus for brushing and bathing feet is provided and consists of an oblong receptacle having two side walls, a front wall, a rear wall, a center wall and a floor that forms two compartments for the feet, a bridge member affixed across top of the two side walls near the front wall of the receptacle to engage insteps of the feet, a plurality of short wall members affixed transverse to the front wall to engage inbetween toes of the feet and brush-like material affixed to inner surfaces of the two side walls, the rear wall, the center wall, the floor, the bridge member and the short wall members so that all parts of the feet can be cleaned by rubbing all parts of the feet against the brush-like material.

5 Claims, 3 Drawing Figures

FOOT BRUSH

BACKGROUND OF THE INVENTION

The instant invention relates generally to receptacles and more specifically it relates to an apparatus for brushing and bathing feet.

When an overweight, pregnant or old person tries to wash their feet it can become difficult and dangerous. They can fall in the shower and injure themselves. This situation is not desirable so accordingly it is in need of an improvement.

SUMMARY OF THE INVENTION

A principle object of the present invention is to provide an apparatus for brushing and bathing feet that is safe and comfortable.

Another object is to provide an apparatus for brushing and bathing feet that will clean the feet faster and more thoroughly.

An additional object is to provide an apparatus for brushing and bathing feet that is made out of durable material that will last for many years.

A further object is to provide an apparatus for brushing and bathing feet that is simple and easy to use.

A still further object is to provide an apparatus for brushing and bathing feet that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
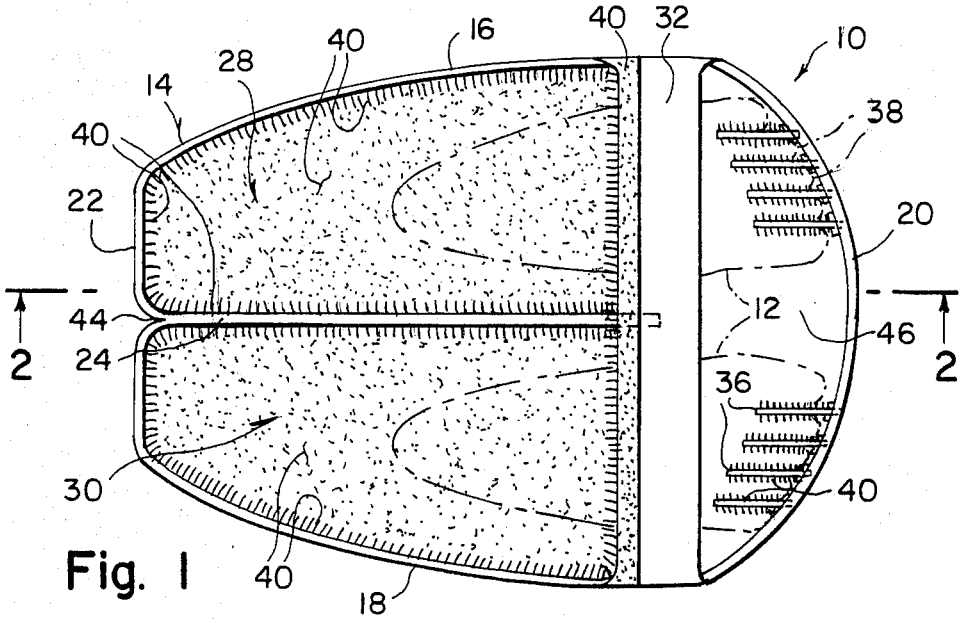
FIG. 1 is a top view of the invention.
Figure 2:
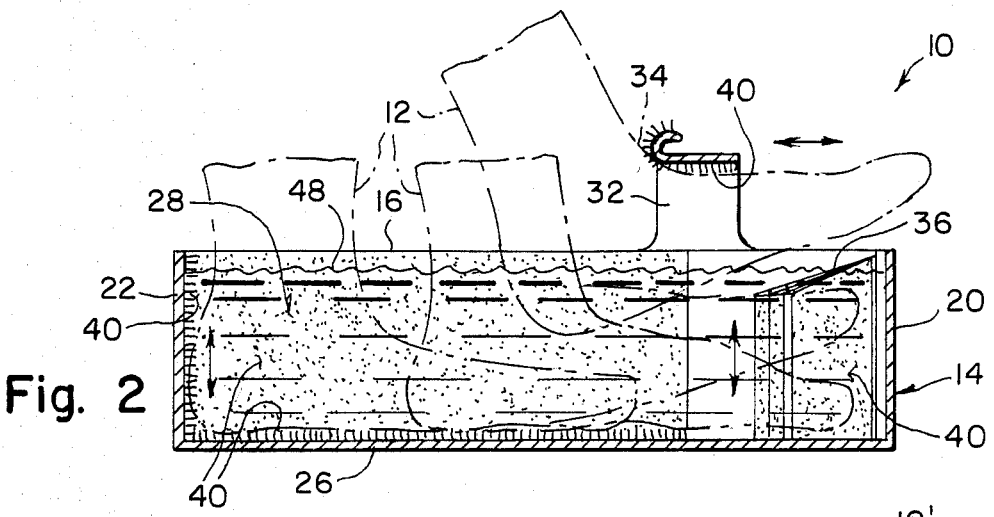
FIG. 2 is a cross sectional view taken along line 2—2 in FIG. 1.

Turning now descriptively to the drawings, in which similar reference characters denote similar elements throughout the several views, FIGS. 1 and 2 illustrates an apparatus 10 for brushing and bathing feet 12. The apparatus 10 consists of an oblong receptacle 14. The receptacle 14 has two side walls 16 and 18, a front wall 20, a rear wall 22, a center wall 24 and a floor 26 that forms two compartments 28 and 30 for the feet 12.

A bridge member 32 is affixed across top of the two side walls 16 and 18 near the front wall 20 of the receptacle 14 to engage insteps 34 of the feet 12. A plurality of short wall members 36 are affixed transverse to the front wall 20 to engage inbetween toes 38 of the feet 12.

Brush-like material 40 is affixed to inner surfaces of the two side walls 16 and 18, the rear wall 22, the center wall 24, the floor 16, the bridge member 32 and the short wall members 36 so that all parts of the feet 12 can be cleaned by rubbing all parts of the feet 12 against the brush-like material 40.

The short wall members 36 are removable from the receptacle 14 at 42 so that the short wall members 36 can be changed for different toe sizes. The center wall

24 is affixed transverse at one end 44 to the rear wall 22 terminating below the bridge member 32 creating an open gap 46 between the compartments 28 and 30 of the receptacle 14. When hot water 48 is poured into the receptacle 14 the hot water 48 can enter both of the compartments 28 and 30 at the same time. The receptacle 14 is watertight so that the receptacle has the ability to hold the hot water 48.

Figure 3:
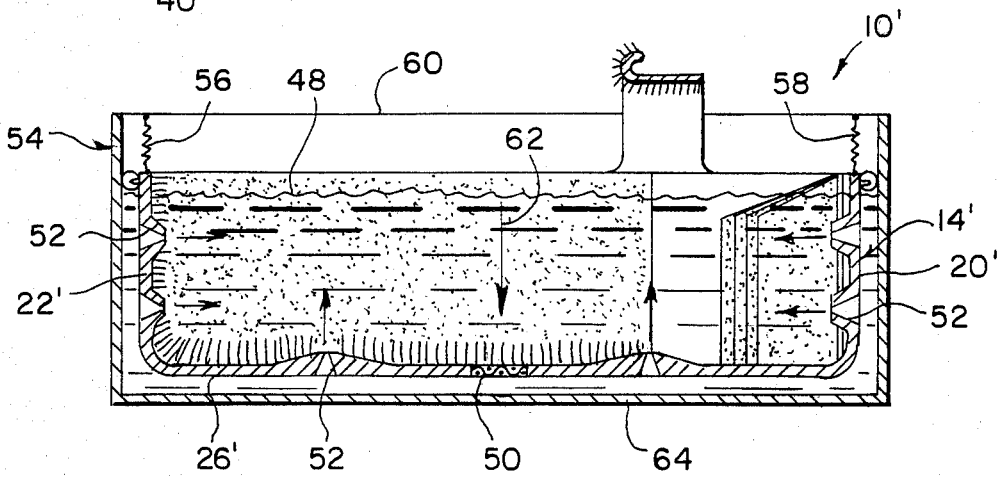
FIG. 3 is a cross sectional view similar to FIG. 2 of a modification of the invention.

FIG. 3 shows a modified apparatus 10' for brushing and bathing feet 12. The receptacle 14' has a drain 50 in the floor 26' and a plurality of water spouts 52 in the front wall 20, the rear wall 22' and the floor 26'.

The receptacle 14' is placed into a watertight container 54 and is spring loaded at 56 and 58 to open top 60 of the container 54. When the feet 12 are placed into the receptacle 14' the receptacle 14' will travel down, shown by arrow 62, to floor 64 of the container 64 forcing the hot water 48 through the spouts 52 to wash the feet 12 while the drain 50 will allow the hot water 48 to return to the container 54.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An apparatus for brushing and bathing feet which comprises:

(a) an oblong receptacle having two side walls, a front wall a rear wall, a center wall and a floor that forms two compartments for the feet;

(b) a bridge member affixed across the top of the two side walls near the front wall of the receptacle to engage insteps of the feet;

(c) a plurality of short wall members affixed transverse to the front wall to engage inbetween toes of the feet; and (d) brush-like material affixed to inner surfaces of the two side walls, the rear wall, the center wall, the floor, the bridge member and the short wall members so that all parts of the feet can be cleaned by rubbing all parts of the feet against the brush-like material.

2. The apparatus for brushing and bathing feet as recited in claim 1, wherein the short wall members are removable from the receptacle so that the short wall members can be changed for different toe sizes.

3. An apparatus for brushing and bathing feet as recited in claim 2, wherein the center wall is affixed transverse at one end to the rear wall terminating below the bridge member creating an open gap between the compartments of the receptacle so that when hot water is poured into the receptacle the hot water can enter both of the compartments at the same time.

4. An apparatus for brushing and bathing feet as recited in claim 3, wherein the receptacle is watertight so that the receptacle has the ability to hold the hot water.

5. An apparatus for brushing and bathing feet as recited in claim 3, wherein the receptacle has a drain in the floor and a plurality of water spouts in the front wall, the rear wall and the floor, the receptacle is placed into the watertight container and is spring loaded to the open top of the container so that when the feet are placed into the receptacle the receptacle will travel down to floor of the container forcing the hot water through the water spouts to wash the feet while the drain will allow the hot water to return to the container.

* * * * *